US006700298B1

(12) United States Patent
Snyder et al.

(10) Patent No.: US 6,700,298 B1
(45) Date of Patent: Mar. 2, 2004

(54) EXTREMELY-EFFICIENT, MINIATURIZED, LONG-LIVED ALPHA-VOLTAIC POWER SOURCE USING LIQUID GALLIUM

(75) Inventors: G. Jeffrey Snyder, Altadena, CA (US); Jagdishbhai Patel, San Gabriel, CA (US); Jean-Pierre Fleurial, Duarte, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 58 days.

(21) Appl. No.: 10/190,452

(22) Filed: Jun. 27, 2002

(51) Int. Cl.[7] ..... G21H 1/00
(52) U.S. Cl. ..... 310/305; 310/304
(58) Field of Search ..... 310/301–305

(56) References Cited

U.S. PATENT DOCUMENTS 3,150,965 A 9/1964 Mayer ..... 75/458
4,178,524 A * 12/1979 Ritter ..... 310/304
4,381,598 A 5/1983 Anthony ..... 438/468
4,538,876 A 9/1985 Hall et al. ..... 439/179
4,731,562 A * 3/1988 Pregenzer ..... 315/111.81
5,111,099 A * 5/1992 Smith ..... 310/305
5,825,839 A * 10/1998 Baskis ..... 376/320
5,861,701 A * 1/1999 Young et al. ..... 310/305
6,143,443 A * 11/2000 Kazacos et al. ..... 429/204
6,191,465 B1 2/2001 Freeouf ..... 257/458
6,303,242 B1 * 10/2001 Leddy et al. ..... 429/10
6,468,688 B2 * 10/2002 Kazacos et al. ..... 429/101

* cited by examiner

*Primary Examiner*—Joseph Waks
(74) *Attorney, Agent, or Firm*—John H. Kusmiss

(57) ABSTRACT

A power source converts α-particle energy to electricity for use in electrical systems. Liquid gallium or other liquid medium is subjected to α-particle emissions. Electrons are freed by collision from neutral gallium atoms to provide gallium ions. The electrons migrate to a cathode while the gallium ions migrate to an anode. A current and/or voltage difference then arises between the cathode and anode because of the work function difference of the cathode and anode. Gallium atoms are regenerated by the receiving of electrons from the anode enabling the generation of additional electrons from additional α-particle collisions.

22 Claims, 1 Drawing Sheet

EXTREMELY-EFFICIENT, MINIATURIZED, LONG-LIVED ALPHA-VOLTAIC POWER SOURCE USING LIQUID GALLIUM

STATEMENT AS TO RIGHTS TO INVENTIONS MADE UNDER FEDERALLY-SPONSORED RESEARCH AND DEVELOPMENT

The invention described herein was made by the performance of work under a NASA contract, and is subject to the provisions of Public Law 96-517 (35 USC 202) in which the contractor has elected not to retain title.

BACKGROUND OF THE INVENTION

1. Field of the Invention

This invention relates to power sources, and particularly to an electrical power source giving rise to a voltage through the ionization of gallium by energetic alpha particles.

2. Description of the Related Art

While most people are familiar with electrical power in their homes and office as being available through an electrical socket or junction, all electrical power must be generated in some manner. Industrial-sized processes in plants allow the generation of megawatts of electricity for distribution over an electric grid powering cities and towns as well as major industrial facilities. However, there is a need for electrical power generation in environments that are otherwise isolated from large scale or other electric power grids. Such environments include orbital and deep space as well as open water and deep ocean exploration and activities.

Prior attempts in the art to supply electrical power for circuitry and equipment include the construction of radioisotope thermoelectric generators (RTGs) as well as lithium batteries, rechargeable batteries, and solar cell panels. Each of these forms of power generation has their advantages and disadvantages. They are also well-documented in the art.

In some circumstances, these prior art generators are not generally miniaturized in order to provide low-power sources. Additionally, the efficiencies of these generators leaves room for improvement as they are not significantly close to 100% efficiency. Further, the useful life of these power supplies is generally limited and usually for less than one year without an available energy source by which they may be re-energized or recharged.

Consequently, there is significant room for improvement with respect to low-energy power sources provided on a miniaturized or other basis for space and ocean exploration missions. The present invention provides an alternative to prior art devices as well as advancing the art by delivering more efficient power source that is self contained, long-lasting, and easily incorporated into advanced and highly-optimized equipment.

SUMMARY OF THE INVENTION

In view of the foregoing disadvantages inherent in the known types of power sources now present in the prior art, the present invention provides an extremely efficient, very compact, and long-lived power source wherein the same can be utilized for supplying electrical power where it would be unavailable otherwise.

The general purpose of the present invention, which will be described subsequently in greater detail, is to provide an extremely efficient, miniaturized, and long-lived power source which is not anticipated, rendered obvious, suggested, or even implied by any of the prior art power sources, either alone or in any combination thereof.

The present invention uses the kinetic energy of α-particles emitted during radioactive decay. Alpha particles are the nuclei of helium atoms that are emitted by radioactive isotopes. In comparison to beta particles (electrons) and gamma rays (high energy electromagnetic radiation), α-particles have higher LET (Linear Energy Transfer) characteristics which makes them more suited for conversion to electrical energy under the proper circumstances. The present invention provides such circumstances in order to convert the comparatively large quantity of available kinetic energy to electrical energy. With the use of radioactive isotopes, to such a power source can be used in environments where other power sources may not be applicable.

Elemental gallium is a semimetal and is generally a liquid above 35° C. (95° F.). By placing liquid gallium between a iridium anode and an zirconium cathode, liquid gallium becomes a carrier of current and a target for bombardment by alpha particles emitted by a radioactive isotope, in this case curium-244. When the α-particles collide with the gallium atoms, the gallium atoms become ionized to supply a free electron and a gallium ion with a +1 charge. The free electrons migrate to the iridium anode while the gallium ions migrate to the zirconium cathode. The work function difference between cathode and anode gives rise to a voltage of approximately 1.62 volts which provides a separating electric field for electrons and gallium ions. This provides a corresponding power level of approximately 20 milliwatts per device.

Devices incorporating the present invention can be connected in series to elevate the voltage and in parallel to elevate the current.

The present invention provides a self-contained power source that may be used for powering many different devices not the least of which is electrical circuitry. Such a supply of power can provide power to an otherwise power-isolated environment such as deep space, deep ocean, and other environments. The construction of the device is generally straightforward and the constituent parts are generally available such that manufacture could occur without significant obstacles. In conjunction with curium-244 radioisotope, a useful life of approximately 18 years corresponding to the half-life of curium-244 is expected. With conversion of the approximately 5.8 million electron volts (MeV) of α-particle kinetic energy being converted with a high degree of efficiency to electrical energy.

OBJECTS OF THE INVENTION

It is an object of the present invention to provide a power source that is self-contained.

It is another object of the present invention to provide a power source that is long-lived.

It is yet another object of the present invention to provide a power source that is efficient.

It is yet another object of the present invention to provide a power source that is small and/or subject to miniaturization.

It is another object of the present invention to provide a power source that lends itself to use in hostile or isolated environments.

It is yet another object of the present invention to provide a power source that is reliable.

It is another object of the present invention to provide a power source that is readily manufactured.

These and other objects and advantages of the present invention will be apparent from a review of the following specification and accompanying drawings.

DESCRIPTION OF THE PREFERRED EMBODIMENT(S)

Figure 1:
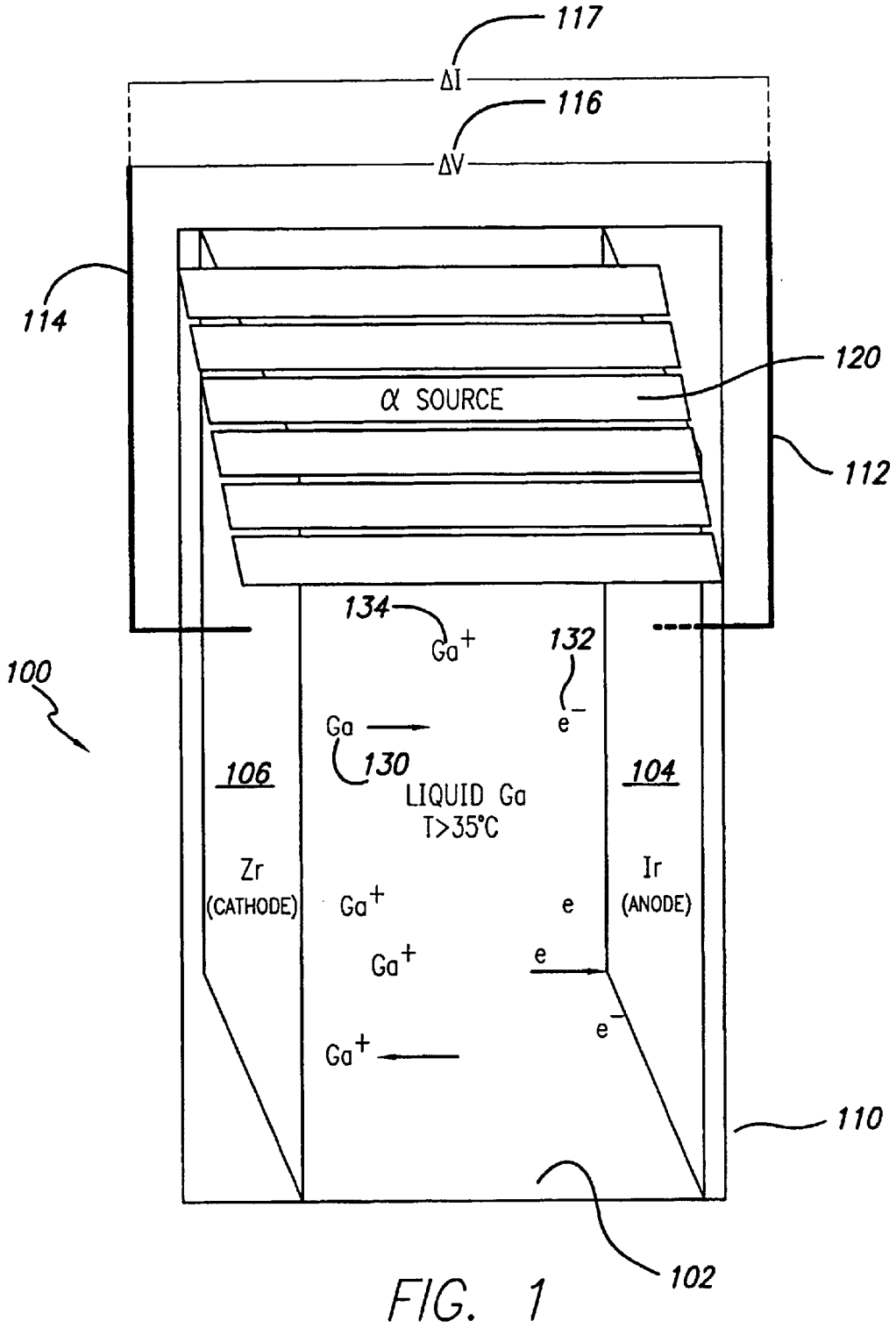
FIG. 1 is a schematic and perspective view of a power source cell implanting the present invention.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

As shown in FIG. 1, the α-voltaic power source 100 uses liquid gallium 102 as a conversion medium for energetic α-particles. The liquid gallium 102 is held between a iridium or other anode 104 and an zirconium or other cathode 106. As used herein, the term "anode" indicates the electron-accepting electrode while the term "cathode" indicates the electron-providing electrode. The anode 104 and cathode 106 may be immersed in the liquid gallium 102. The cathode and anode are placed in such a way that the majority of the liquid gallium 102 is disposed between the anode 104 and cathode 106. The anode lead 112 and the cathode lead 114 may pass through the holding container 110 or otherwise be in communication with the respective anode 104 or cathode 106. Depending upon the work function of the anode 104 and cathode 106, a voltage ΔV 116 is present between the anode lead 112 and cathode lead 114. This constitutes an electric field in liquid gallium which facilitates the separation of negatively-charged electrons and positively-charged gallium ions. As described in more detail below, where the anode is iridium and the cathode is zirconium, the voltage arising between the anode lead 112 and cathode lead 114 is approximately 1.62 volts which is the difference between the work functions of iridium and zirconium.

Elemental gallium is generally a liquid and has a melting point of approximately 30° C. (302.9° K., 85.8° F.). Despite the cold of deep space, deep ocean, or other environments, it is generally a simple task to keep gallium in liquid state as heating can also be accomplished by the dissipation of energy of incoming α-particles, radioisotope heating, or otherwise. Additionally, gallium has a boiling point of approximately 2403° C. (2676° K., 4357° F.). Consequently, if liquid gallium used in the power source 100 of the present invention becomes hot, it will remain a viable "electrolyte" for the generation and migration of gallium ions and electrons to significantly high temperatures.

In order to activate the liquid gallium in order to provide sources of charge and sources of charge absorption, α-particles are used as a result of natural radioactive decay from an α-particle source.

Curium-244 may be used as a source of α-particles. Upon emission, the α-particles travel into the liquid gallium 102 and collide with the gallium atoms. When the α-particles collide with the gallium atoms, electrons are liberated from the electron shells of the gallium atoms. These freed electrons are then able to migrate through the liquid gallium over to the iridium or other anode 104.

When electrons 132 are free from the originally-neutral gallium atoms 130, positive gallium ions (in the form of Ga+ or otherwise) 134 are created. The gallium ions 134 then migrate to the zirconium or other cathode 106 where they receive electrons to re-form neutral gallium atoms 130.

A propitious disposition of the α-source 120 as well as providing a depth of liquid gallium 102 beyond the mean the travel distance of the emitted alpha particles, enables the α-voltaic power source 100 of the present invention to capture a large percentage of emitted α-particles. This enables a large percentage of the a-particle energy to be deposited into the liquid gallium 102 and the creation of electrons 132 and gallium ions 134 in order to create the current 117 and voltage difference 116 across the anode lead 112 and the cathode lead 114.

Geometrically, the α-particle source 120 may be disposed centrally in a reservoir of gallium liquid 102. This would allow for omnidirectional α-source emission to quickly encounter the liquid gallium 102. A large number of α-particles will then be captured by the gallium liquid and converted into electrical energy by a liberation of electrons 132 from neutral gallium atoms 130.

Contemplated sources of α-particles include curium-244 which emits energetic α-particles with energies of approximately 5.8 MeV. Curium-244 has a half-life of approximately 18 years and so could provide a predictable current 117 across the leads 112, 114 for this half-life period. Typical α-particle activity rates are contemplated as being on the order of approximately 1 Curie (Ci) which is approximately $3.7\times10^{10}$ α-particles per second. As mentioned above, a voltage of approximately 1.6 volts is generally delivers a current 117 of approximately 10–12 milliamps and a power level of approximately 20 milliwatts. In delivering a voltage, current, and power as indicated, each device is expected to be only approximately 25 $mm^3$ in volume. As with batteries, a series of power sources 100 could be connected serially for greater voltage, in parallel for greater current, or in both series and parallel to deliver greater voltage and current.

Other materials may be used in substitution for the gallium liquid so long as they provide for the proper migration of ions and electrons as well as being good targets for α-particle interception. Semimetals are good candidates for such alternative materials, as may be other liquids or fluids. Additionally, while iridium and zirconium have been respectively indicated for anode 104 and cathode 106 plates, additional materials may be used in place of zirconium and iridium to good effect. The resulting voltage 116 would generally be the difference between the work functions of the anode and cathode 104, 106.

Furthermore, while a source of α-particles is set forth herein and the use of curium-244 is mentioned with particularity, other sources of α-particles may also be constructively used in the present invention. Other sources of radiation, such as sources of β-rays or γ-rays may also provide for generation of electrical power along the lines as described herein. The target liquid 102 generally has to be a liquid semiconductor or a semi-metal with properties generally closer to a semiconductor in order to be a good receiving target for either the γ-rays or β-rays and should respond in a manner like that of gallium in its receipt of α-particles and generation of electricity therefrom. The use of the term "liquid" as set forth herein encompasses any fluid acting as the atomic/molecular resource from which ions, electrons can be generated by particle collision.

While the present invention has been described with regards to particular embodiments, it is recognized that additional variations of the present invention may be devised without departing from the inventive concept.

What is claimed is:

1. A power source for providing electrical energy, comprising:

a particle-emitting source radiating particles having kinetic energy;

an ionizable liquid receiving said particles from said particle-emitting source, said ionizable liquid ionizing into ions and electrons when said particles collide with said liquid; and said ions and electrons are separately collectable; whereby a current is generated by separate collection of said ions and electrons.

2. A power source for providing electrical energy as set forth in claim 1, further comprising:

a cathode, said cathode receiving said ions.

3. A power source for providing electrical energy as set forth in claim 1, further comprising:

an anode, said anode receiving said electrons.

4. A power source for providing electrical energy as set forth in claim 2, wherein said cathode is zirconium.

5. A power source for providing, electrical energy as set forth in claim 3, wherein said anode is iridium.

6. A power source for providing electrical energy as set forth in claim 1, further comprising:

a zirconium cathode, said cathode receiving said ions; and an iridium anode, said anode receiving said electrons.

7. A power source for providing electrical energy as set forth in claim 6, further comprising:

said ionizable liquid in communication with said cathode and said anode;

said ions migrating to said cathode and said electrons migrating to said anode.

8. A power source for providing electrical energy as set forth in claim 7, wherein said particle-emitting source comprises:

a radioactive element.

9. A power source for providing electrical energy as set forth in claim 8, wherein said radioactive element comprises:

an alpha-particle ($\alpha$-particle) emitting element.

10. A power source for providing electrical energy as set forth in claim 9, wherein said alpha-particle ($\alpha$-particle) emitting element comprises:

curium-244.

11. A power source for providing electrical energy as set forth in claim 7, wherein said ionizable liquid comprises:

an element of the periodic table.

12. A power source for providing electrical energy as set forth in claim 7, wherein said liquid element comprises:

a semimetal.

13. A power source for providing electrical energy as set forth in claim 12, wherein said liquid element comprises:

gallium.

14. A power source for providing electrical energy, comprising:

a cathode;

an anode;

a particle-emitting source radiating particles having kinetic energy;

an ionizable liquid in communication with said cathode and said anode and receiving said particles from said particle-emitting source, said ionizable liquid ionizing into ions and electrons when said particles collide with said liquid;

said ions migrating to said cathode and said electrons migrating to said anode; whereby a current is generated across said cathode and anode.

15. A power source for providing electrical energy as set forth in claim 14, further comprising:

said ions and electrons migrating under the influence of an electric field.

16. A power source for providing electrical energy as set forth in claim 14, wherein said cathode is zirconium.

17. A power source for providing electrical energy as set forth in claim 14, wherein said anode is iridium.

18. A power source for providing electrical energy as set forth in claim 14, wherein said particle-emitting source comprises:

a radioactive element.

19. A power source for providing electrical energy as set forth in claim 18, wherein said radioactive element comprises:

curium-244.

20. A power source for providing electrical energy as set forth in claim 14, wherein said ionizable liquid comprises:

a liquid element of the periodic table.

21. A power source for providing electrical energy as set forth in claim 20, wherein said liquid element comprises:

gallium.

22. A power source for providing electrical energy, comprising:

an zirconium cathode;

a iridium anode;

a particle-emitting source including curium-244 radiating alpha particles having kinetic energy; and an ionizable liquid including gallium in communication with said cathode and said anode and receiving said particles from said particle-emitting source, said ionizable liquid ionizing into ions and electrons when said particles collide with said liquid; whereby said ions migrating to said cathode and said electrons migrating to said anode such that a current is generated across said cathode and anode.

* * * * *